United States Patent [19]

Harmon

[11] 4,074,369

[45] Feb. 21, 1978

[54] SHAMPOOING UNIT

[76] Inventor: Flossie G. Harmon, 3109 N. 15th St., Philadelphia, Pa. 19132

[21] Appl. No.: 703,690

[22] Filed: July 8, 1976

[51] Int. Cl.[2] ..... A61H 35/00

[52] U.S. Cl. ..... 4/159; 34/100

[58] Field of Search ..... 4/159, 166, 1; 34/100; 132/9

[56] References Cited

U.S. PATENT DOCUMENTS

| | | | |
|---|---|---|---|
| 998,804 | 7/1911 | Salisbury | 4/159 |
| 3,088,459 | 5/1963 | Rabinoff | 4/153 |
| 3,281,948 | 11/1966 | Goble | 132/9 |
| 3,456,655 | 7/1969 | Hale | 132/9 |

*Primary Examiner*—Richard E. Aegerter
*Assistant Examiner*—L. Footland

[57] ABSTRACT

A lightweight shampooing unit is disclosed comprising a hood having a manifold therein for directing water, shampoo or air into the hood and an outlet for discharging water, shampoo or air, the hood being adapted to be worn on the head around the scalp area, a sealing member being provided on the edge of the hood to prevent leakage of air, water or shampoo from the hood when in use. A water supply, pump and shampoo supply as well as an air blower are operatively connected through valves for delivering water or shampoo or air under pressure to the manifold in the hood, the water or shampoo being supplied under sufficient pressure to provide an agitating action within the hood. The discharge end of the hood is connected into a valve which is operable to either recirculate shampoo or rinse water through the pump and back into the manifold for efficient use of the shampoo and the rinse water or to vent the rinse water and shampoo as well as air from the hood.

4 Claims, 3 Drawing Figures

SHAMPOOING UNIT

SUMMARY OF THE INVENTION

The present invention relates to a portable shampooing unit comprising a lightweight flexible hood, a sealing member extending around the opening in the hood for holding the hood to the scalp area of the head of a person and substantially preventing leakage of air and water or shampoo from the hood when the hood is in position on the head of a person. A flexible manifold is positioned in the hood, a first conduit leading into the manifold for delivering a fluid to the manifold through openings therein and onto the scalp of a person through the manifold. A second conduit leads out of the hood for venting the hood of a fluid such as water, shampoo or air. A water supply is operatively connected to a water pump, the water supply comprising either a conduit leading into a water tap or a water reservoir. A shampoo supply, air pump and first valve is also provided, the first valve being movable into a first position for operatively connecting the discharge end of the water pump and the shampoo supply with the first conduit. The first valve is further movable into a second position for operatively connecting the discharge end of the water pump with the first conduit, the first valve additionally being movable into a third position for operatively connecting the discharge end of the air pump with the first conduit. A second valve in the shampooing unit is movable into a first position for operatively connecting the second conduit to the influent end of the water pump the second valve also being movable into a second position for discharging fluids from the second conduit whereby shampoo and water can be delivered under pressure to the manifold through the first conduit and provide an agitating action in the hood and recirculated through the second conduit into the first conduit to provide efficient use of shampoo and rinse water after which such shampoo and water may be discharged and an air stream for drying hair can be introduced into the hood and vented from the hood.

In one embodiment the manifold comprises a flexible envelope having perforate openings on the inner wall thereof for delivering a fluid onto the scalp of a person.

In a further embodiment the first valve comprises a rotary valve having a first channel and a second channel, both the first and second channels being simultaneously movable. The first valve is operatively connected to the first conduit through a third conduit and a fourth conduit leading from the first valve into the first conduit. The first valve is rotatable into a first position for operatively connecting the water pump and the inlet end of the shampoo supply through the first channel and simultaneously connecting the second channel with the outlet end of the shampoo supply and the fourth conduit. The first valve is additionally movable into a second position for operatively connecting the outlet end of the water pump and the third conduit through the first channel, the first valve also movable into a third position for connecting the outlet of the air pump to the first conduit through either one of the first channels or the second channels and one of the third conduits or one of the fourth conduits. A member or arrangement of conduits and openings is provided for preventing the first channel and the second channel from being rotated to operatively connect the outlet of the water pump with the outlet of the air pump.

The air blower has a heating element therein for heating air discharged from the outlet of the blower, the heater in one embodiment comprising an electric heater in the air blower, whereas the air blower comprises an electric motor driven fan. A switch is operatively engaged by the first valve for supplying electric power simultaneously to the heater and the electric motor when the first valve is rotated into the third position.

The shampooing unit of the present invention may also have a pressure valve bypass member on the water pump for recirculating liquid from the outlet of the water pump to the inlet of the water pump when the first valve is in the third position.

DETAILED DESCRIPTION

Shampooing units are described in the prior art, U.S. Pat. Nos. 3,694,826 Pugh; 3,416,517 Adams, et al; 3,013,280 Coffman, et al; 2,850,742 Glintz; and 2,682,058 Wolfe.

Adams, et al (supra) discloses a cumbersome rigid hoodlike apparatus placed over the head of a person in which mechanical arms and fingers are employed for engaging the scalp area, the mechanical arms and fingers being driven by an electric motor. Various hoses are connected to the hood for injecting soap, water ozone and other compounds into the hood. The hood is extremely heavy because of the various mechanical implements employed therein for scrubbing hair and scalp and is uncomfortable to wear. Furthermore, the mechanical agitators provided in the hood of Adams, et al are difficult to adjust for providing the right degree of agitation, excessive agitation causing severe problems with irritating or abradding the scalp, mild agitation being inadequate to properly cleanse the hair and scalp in many instances.

The prior art references noted above also comprise disclosures of apparatus that is excessively cumbersome and difficult to move about.

It is therefore an object of the present invention to overcome these and other difficulties encountered in the prior art.

It is also an object of the present invention to provide a portable shampooing unit having a lightweight flexible hood.

It is a further object of the present invention to provide a portable shampooing unit in which the hood does not have mechanical agitating means therein for rubbing the scalp or hair.

It is a further object of the present invention to provide a shampooing unit for washing and setting hair of people who are immobilized such as people confined to a hospital bed or wheelchair or those unable to bend over or otherwise sit down to have their hair washed and/or set.

It is a further object of the present invention to provide a portable shampooing unit which may be placed on the head of a person in the scalp area and can agitate and massage the scalp area and hair without the use of mechanical fingers.

These and other objects have been achieved by the present invention and will become apparent from the disclosure and claims that follow as well as the appended drawing.

Figure 1:
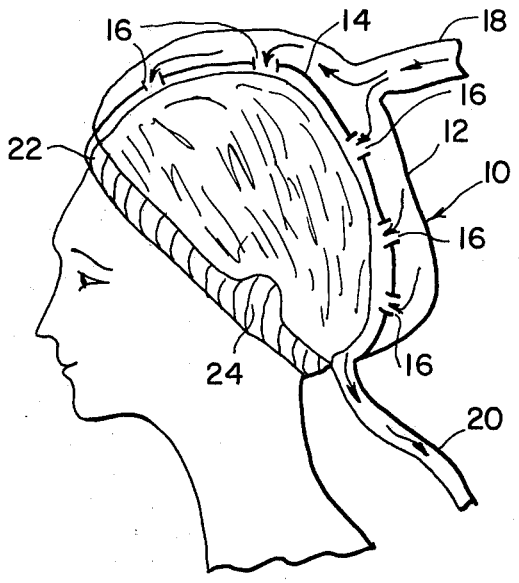
FIG. 1 is a side elevation partially in section illustrating a hood to be worn around the scalp area of the head of a person, the hood having a manifold and an inlet and outlet for delivering a fluid under pressure to the scalp area and discharging it from the hood according to one embodiment of the present invention.
Figure 2:
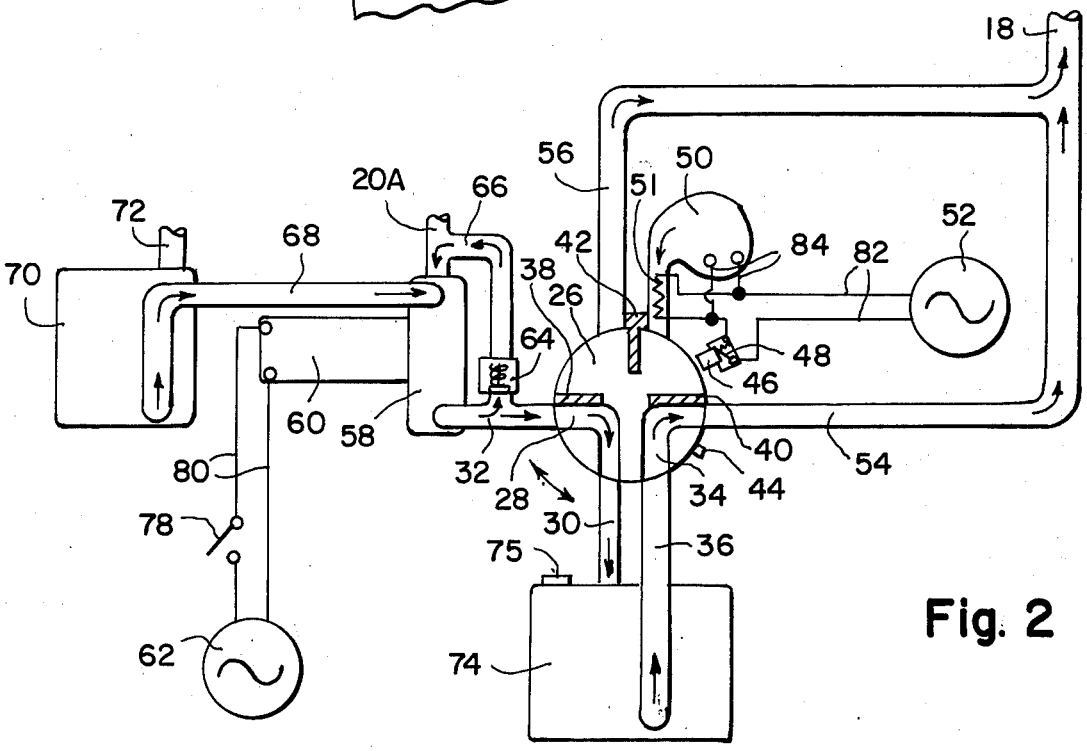
FIG. 2 is a side elevation illustrating a water supply, pump, shampoo supply and air blower operatively connected for delivering shampoo, water or air to a flexible lightweight hood and either venting the water or shampoo or recirculating it for efficient use and for venting air from such a hood according to another embodiment of the present invention.
Figure 3:
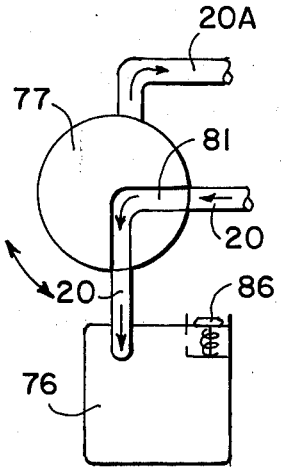
FIG. 3 is a side elevation in section illustrating a bypass valve for directing the flow of a fluid from the discharge end of a flexible hood either into a pump as illustrated in FIG. 2 or for discharging such a fluid into a container or otherwise discharging such a fluid according to an embodiment of the present invention.

Referring to the drawing and FIGS. 1–3 thereof, a portable shampooing unit is disclosed and illustrated comprising a lightweight flexible hood 10, made of a soft plastic material such as rubber, polyvinyl chloride, polypropylene, polyethylene, the copolymers thereof and the art known equivalents thereof, a sealing member 22 extending around the opening in the hood for holding the hood to the scalp area of the head of a person and substantially preventing leakage of air and water from the hood when the hood is in this position. The sealing member 22 extends into an ear protecting pad 24 which seals the wearer's ear from substantial contact with shampoo, water or air. Band 22 may be a polyurethane foam band enveloped in a soft thermoplastic flexible material such as polyethylene, polyvinyl chloride and copolymers thereof and the art known equivalents. A draw string may be provided in band 22 in order to further provide an adequate seal between the band and the head of a person when the hood is in position. Additionally, sealing member 22 may comprise an inflatable envelope encircling the opening of the hood 10 to provide an adequate seal as described previously.

A manifold is provided within hood 10 comprising an outer wall 12 of the hood and an inner wall 14 made of the materials that hood 10 may be constructed of having openings 16 therein, a first conduit 18 in fluid communication with the envelope formed between inner wall 14 and outer wall 12. A second conduit 20 leads out of the hood for venting any fluids that are passed into the hood through conduit 18 and out of perforate openings 16.

The hood 10 is operatively connected to apparatus illustrated in FIGS. 2 and 3, which may be a compact unit carried in a suitcase and comprises a water supply such as a water reservoir 70 having an influent conduit 72 leading into reservoir 70 for supplying either fresh water to reservoir 70. Conduit 68 leads out of reservoir 70 into centrifugal pump 58 which is turned by electric motor 60 operatively connected to an electrical power source 62 by means of electrical conduit 80 and switch 78. Pump 58 may be a hand or foot operated pump. An outlet conduit 32 leads from pump 58 into a valve 26, a recycling conduit 66 being provided for leading fluid from the outlet end of pump 58 into the inlet end of pump 58, conduit 66 having a pressure relief bypass valve 64 therein which opens when back-pressure in conduit 32 builds up to a predetermined level so that fluid in conduit 32 will be recycled to the influent end of pump 58 by means on conduit 66.

A rotary valve 26 having a first chamber 28 and a second chamber 34 both of said chambers being simultaneously movable or rotatable is operatively connected to a third conduit 56, a fourth conduit 54, an air pump 50 and a shampoo supply member such as a shampoo supply reservoir 74 having a filler cap 75 thereon for the introduction of shampoo into the reservoir 74. Shampoo reservoir 74 is connected to valve 26 by means of an influent conduit 30 and an effluent conduit 36. Air pump 50 comprises an electric motor-driven fan, a heating element 51 being provided in the outlet end of air pump 50, the electric motor of pump 50 in addition to heating element 51 being operatively connected to an electric power source 52 by means of electrical conduits 84 and 82 respectively. A cam 44 is secured to one edge of rotary valve 26, a cam follower 46 operatively engaging a spring loaded single pole, single throw switch 48 operatively engaging cam follower 46 so that when cam 44 is rotated into contact with cam follower 46, switch 48 will be thrown to provide electric power not only to air pump 50 but also heating element 51. A second valve or recycling valve 77 having a channel 81 therein is connected to conduit 20 and conduit 20A valve 77 being rotatable so that channel 81 therein may be used to direct a discharge fluid from conduit 20 into reservoir 76 or to recycle a discharge fluid from conduit 20 into conduit 20A and back into pump 58. In order to prevent a liquid such as shampoo or water from being circulated from conduit 32 into air pump 50, the various openings on valve 26 and the various connections of valve 26 to conduits 32, 56, air pump 50, conduit 54 and conduits 30 and 36 are arranged so that the only positions available for discharging a fluid from valve 26 into conduit 18 are water shampoo mixtures, water or air, as is illustrated in the embodiment shown in FIG. 2. In order to prevent valve 26 from being rotated through more than 360° for the convenience of the user, a key 38 and a key 40 extend outwardly from the valve and are part of the valve, these keys 38 and 40 engaging a block 42 which is secured to blower 50.

In use, reservoir 70 is filled with water and reservoir 74 is filled with shampoo, after which switch 78 is thrown in order to turn pump 58 by means of electrical motor 60. Water is then drawn out of reservoir 70 through conduit 68 and into conduit 32, chamber 28 in valve 26 out of valve 26 into conduit 30 which leads into shampoo reservoir 74. The water under pressure mixes with the shampoo in reservoir 74 and is forced out of the bottom thereof and up through conduit 36 through channel 34 and out of conduits 54 and 18. This mixture of shampoo and water cannot be forced toward valve 26 through conduit 56 since the valve in the position illustrated in FIG. 2 cuts off any access to conduit 56 from valve 26. Shampoo and water are thus delivered into hood 10 through the openings 16 and impinges with sufficient pressure against the scalp and hair of a person having the hood 10 positioned in the scalp area that agitation is provided which is sufficient to remove oil and dirt from the hair, after which this shampoo solution is vented through conduit 20 into valve 77 through chamber 81 in valve 77 and then collected in reservoir 76. This initial shampooing is only conducted for a relatively short period of time and short enough not to completely exhaust the supply of shampoo in reservoir 74. After the first application of shampoo, the process is repeated again, except that valve 77 on the second washing is turned so that conduit 20 is connected operatively with conduit 20A by means of chamber 81 in valve 77 and opening 20A on top of pump 58. During this recycling operation, valve 26 is rotated so that the discharge conduit 32 from pump 58 is operatively connected to conduit 56, through channel 28. The recycling is continued until washing is complete after which valve 77 is rotated so that chamber 81 therein operatively connects conduit 20 with discharge reservoir 76. The multiple application of shampoo is a more efficient use of any single quantity of shampoo applied in a single application. The valves are kept in this position whereupon water from reservoir 70 is led into pump 58 by means of conduit 68 and through conduit 32, channel 28 in valve 26 and out of conduit 56 to supply rinse water which after a few minutes of rinsing may be recirculated by rotating chamber 81 in valve 77 to connect conduit 20 with conduit 20A. The rinse water may then be recirculated or vented into reservoir 76 several times until the rinsing procedure is completed. This multiple application of rinse water is a more efficient use of any single quantity of rinse water applied in one application. Valve 26 upon completion of the rinsing procedure is then rotated so that cam 44 engages cam follower 46 to connect electrical power from power source 52 through conduits 82 and 84 to heating element 51 and an electric motor in air pump 50. The rotation of valve 26 in this manner also brings chamber 34 of valve 26 to operatively connect air pump 50 with conduit 54 whereupon heated air is brought into hood 10 to dry the hair and scalp after the shampooing and rinsing process. Heated air is discharged through tube 20 and valve 77 is arranged to direct the flow of this air into reservoir 76 whereupon it is vented through poppet valve 86.

Although the invention has been described by reference to certain embodiments, it is not intended that the novel shampooing unit be limited thereby but that modifications thereof are intended to be included as falling within the broad spirit and scope of the foregoing disclosure, the following claims and the appended drawing.

What is claimed is:

1. A portable shampooing unit comprising lightweight flexible hood means, sealing means extending around the opening in said hood for holding said hood to the scalp area of the head of a person and substantially preventing leakage of air, shampoo and water from said hood when said hood is in position, flexible manifold means in said hood, first conduit means leading into said manifold opening means in said manifold to provide fluids adjacent the scalp area of a person wearing said hood, second conduit means leading out of said hood for venting said hood of liquid or air, water supply means operatively connected to water pump means, shampoo supply means, air pump means and first valve means, said first valve means being movable into a first position for operatively connecting the discharge end of said water pump and said shampoo supply with said first conduit, said first valve being movable into a second position for operatively connecting the discharge end of said water pump with said first conduit, said first valve being movable into a third position for operatively connecting the discharge end of said air pump with said first conduit, said first valve means comprises a rotary valve having first channel means and second channel means simultaneously movable therein, said first valve operatively connected to said first conduit through third conduit means and fourth conduit means leading from said first valve into said first conduit, said first valve being rotatable into a first position for operatively connecting said pump and the inlet end of said shampoo supply through said first channel and simultaneously connecting said second channel with the outlet end of said shampoo supply and said fourth conduit, said first valve movable into a second position for operatively connecting the outlet end of said pump and said third conduit through said first channel, said first valve movable into a third position for connecting the outlet of said air pump to said first conduit through one of said first channel means and said second channel means, and one of said third conduit means and said fourth conduit means, means for preventing said first channel and said second channel from being rotated to operatively connect the outlet of said water pump with the outlet of said air pump, second valve means movable into a first position for operatively connecting said second conduit to the influent end of said water pump, said second valve being movable into a second position for discharging fluids from said second conduit whereby shampoo and water can be delivered under pressure to said manifold through said first conduit and provide an agitating action in said hood after which said shampoo or water may be recirculated through said second conduit into said pump to provide efficient use of shampoo or rinse water after which such shampoo or rinse water may be discharged and an air stream for drying hair can be introduced into the hood and vented from the hood.

2. The shampooing unit of claim 1 where said air blower has heater means therein for heating air discharged from the outlet of said blower.

3. The shampooing unit of claim 1 where said heater comprises an electric heater, said air pump comprises electric motor driven fan means, switch means operatively engaged by said first valve for supplying electric power simultaneously to said electric heater and electric motor when said first valve is rotated into said third position.

4. The shampoo unit of claim 1 further comprising pressure valve bypass means on said water pump for recirculating liquid from the outlet of said water pump to the inlet of said water pump when said first valve is in said third position.

* * * * *